US008602103B2

(12) United States Patent
LaMont et al.

(10) Patent No.: US 8,602,103 B2
(45) Date of Patent: Dec. 10, 2013

(54) GENERATION OF FLUID FOR HYDROCARBON RECOVERY

(75) Inventors: David C. LaMont, Calgary (CA); James P. Seaba, Bartlesville, OK (US)

(73) Assignee: ConocoPhillips Company, Houston, TX (US)

( * ) Notice: Subject to any disclaimer, the term of this patent is extended or adjusted under 35 U.S.C. 154(b) by 384 days.

(21) Appl. No.: 12/950,194

(22) Filed: Nov. 19, 2010

(65) Prior Publication Data

US 2011/0120717 A1 May 26, 2011

Related U.S. Application Data

(60) Provisional application No. 61/263,898, filed on Nov. 24, 2009.

(51) Int. Cl.
*E21B 43/24* (2006.01)

(52) U.S. Cl.
USPC ..... 166/303; 166/272.3; 166/272.4; 166/401

(58) Field of Classification Search
None
See application file for complete search history.

(56) References Cited

U.S. PATENT DOCUMENTS

| | | | | | |
|---|---|---|---|---|---|
| 3,344,856 | A * | 10/1967 | Lange | 166/245 |
| 3,360,044 | A * | 12/1967 | Lange | 166/260 |
| 3,411,583 | A * | 11/1968 | Holm et al. | 166/305.1 |
| 3,768,559 | A * | 10/1973 | Allen et al. | 166/272.3 |
| 3,823,776 | A | 7/1974 | Holmes | |
| 3,980,137 | A * | 9/1976 | Gray | 166/256 |
| 4,224,991 | A * | 9/1980 | Sowa et al. | 166/272.3 |
| 4,327,805 | A * | 5/1982 | Poston | 166/401 |
| 4,475,883 | A * | 10/1984 | Schirmer et al. | 431/158 |
| 4,580,504 | A * | 4/1986 | Beardmore et al. | 110/261 |
| 4,687,058 | A * | 8/1987 | Casad et al. | 166/272.2 |
| 4,697,642 | A * | 10/1987 | Vogel | 166/272.3 |
| 4,726,759 | A * | 2/1988 | Wegener | 431/4 |
| 4,729,431 | A | 3/1988 | Bousaid | |
| 4,861,263 | A * | 8/1989 | Schirmer | 431/158 |
| 5,339,904 | A * | 8/1994 | Jennings et al. | 166/303 |
| 5,449,038 | A | 9/1995 | Horton et al. | |
| 5,458,193 | A | 10/1995 | Horton et al. | |
| 5,758,605 | A * | 6/1998 | Calkins | 122/31.1 |
| 6,230,814 | B1 * | 5/2001 | Nasr et al. | 166/400 |
| 6,591,908 | B2 * | 7/2003 | Nasr | 166/272.3 |

(Continued)

FOREIGN PATENT DOCUMENTS

| | | |
|---|---|---|
| CA | 2185837 | 3/1998 |
| CA | 2332685 | 10/2001 |

(Continued)

OTHER PUBLICATIONS

Thimm, "Solvent co-injection in SAGD : Prediction of some operational issues" J. Canadian Petr. Tech., 44:7-10 (2005).

(Continued)

*Primary Examiner* — Angela M DiTrani
*Assistant Examiner* — Anuradha Ahuja
(74) *Attorney, Agent, or Firm* — ConocoPhillips Company

(57) ABSTRACT

Methods and apparatus relate to recovering petroleum products from underground reservoirs. The recovering of the petroleum products relies on introduction of heat and solvent into the reservoirs. Supplying water and then solvent for hydrocarbons in direct contact with combustion of fuel and oxidant generates a stream suitable for injection into the reservoir in order to achieve such thermal and solvent based recovery.

7 Claims, 1 Drawing Sheet

(56) References Cited

U.S. PATENT DOCUMENTS

| | | | | |
|---|---|---|---|---|
| 6,662,872 | B2 * | 12/2003 | Gutek et al. | 166/272.4 |
| 7,464,756 | B2 | 12/2008 | Gates et al. | |
| 7,780,152 | B2 * | 8/2010 | Rao | 261/79.1 |
| 7,870,904 | B2 * | 1/2011 | Hocking | 166/302 |
| 8,091,625 | B2 * | 1/2012 | Ware et al. | 166/59 |
| 8,286,707 | B2 * | 10/2012 | Schultz et al. | 166/303 |
| 2003/0062159 | A1 * | 4/2003 | Nasr | 166/272.1 |
| 2004/0146602 | A1 | 7/2004 | Garwood et al. | |
| 2004/0204324 | A1 | 10/2004 | Baltoiu et al. | |
| 2004/0214726 | A1 * | 10/2004 | Tudor | 507/200 |
| 2006/0009595 | A1 | 1/2006 | Rix et al. | |
| 2006/0258555 | A1 | 11/2006 | Filippini et al. | |
| 2007/0034553 | A1 | 2/2007 | Baltoiu et al. | |
| 2007/0193748 | A1 * | 8/2007 | Ware et al. | 166/303 |
| 2007/0202452 | A1 * | 8/2007 | Rao | 431/354 |
| 2008/0017372 | A1 * | 1/2008 | Gates et al. | 166/254.1 |
| 2008/0083653 | A1 | 4/2008 | Bruha | |
| 2008/0217003 | A1 | 9/2008 | Kuhlman et al. | |
| 2009/0008096 | A1 * | 1/2009 | Schultz et al. | 166/303 |

FOREIGN PATENT DOCUMENTS

| | | |
|---|---|---|
| CA | 2386459 | 1/2002 |
| CA | 2433355 | 3/2002 |
| CA | 2325777 | 10/2002 |
| CA | 2351148 | 12/2002 |
| CA | 2605724 | 11/2006 |
| CA | 2552482 | 1/2008 |
| GB | 2451600 | 4/2009 |
| WO | 02098553 | 12/2002 |
| WO | 200750479 | 5/2007 |
| WO | 2007117865 | 10/2007 |

OTHER PUBLICATIONS

"In Situ Recovery Technologies," Alberta Research Council (2008).

Al-Bahlani, A.M. and Babadagli, T.: "Heavy-Oil Recovery in Naturally Fractured Reservoirs with Varying Wettability by Steam Solvent Co-Injection," SPE 117626, 2008 SPE Int. Thermal Oper. and Heavy-Oil Symp.. Calgary, AB, Canada, Oct. 20-23, 2008.

Nasr, et al. "Heavy Oil Recovery in Russia: SAGD & ES-SAGD Technologies," Oil & Gas News Rogtec (2009).

* cited by examiner

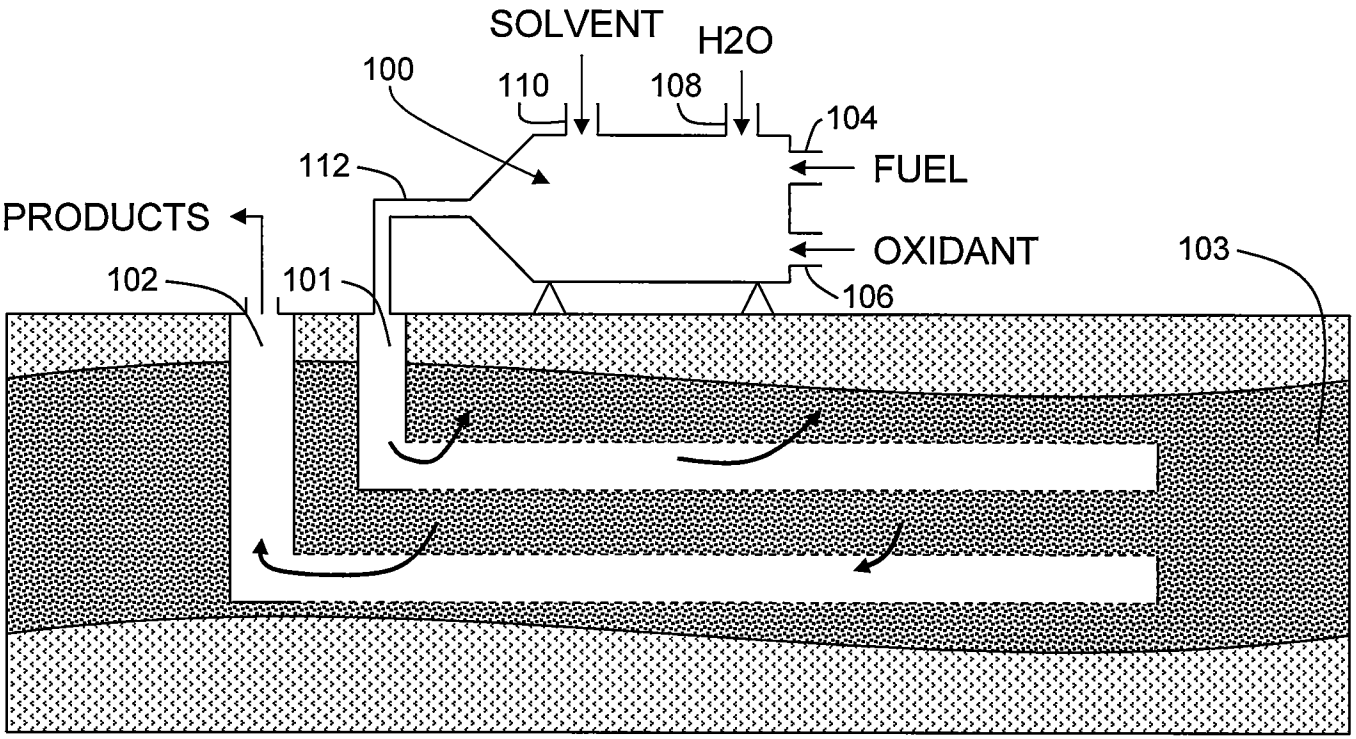
SOLVENT
H2O
FUEL
OXIDANT
PRODUCTS
100
101
102
103
104
106
108
110
112

GENERATION OF FLUID FOR HYDROCARBON RECOVERY

CROSS-REFERENCE TO RELATED APPLICATIONS

This application is a non-provisional application which claims benefit under 35 USC §119(e) to U.S. Provisional Application Ser. No. 61/263,898 filed Nov. 24, 2009, entitled "GENERATION OF FLUID FOR HYDROCARBON RECOVERY," which is incorporated herein in its entirety.

STATEMENT REGARDING FEDERALLY SPONSORED RESEARCH OR DEVELOPMENT

None

FIELD OF THE INVENTION

Embodiments of the invention relate to methods and systems for steam assisted oil recovery.

BACKGROUND OF THE INVENTION

Conventional processes for production of hydrocarbons from heavy oil or bitumen containing formations utilize energy and cost intensive techniques. In addition to the cost, other viability criteria relate to generation of carbon dioxide ($CO_2$) during recovery of the hydrocarbons. In order to recover the hydrocarbons from certain geologic formations, injection of steam increases mobility of the hydrocarbons within the formation via one of the processes known as steam assisted gravity drainage (SAGD). Exemplary problems with utilizing such prior techniques include inefficiencies, amount of the carbon dioxide created and difficulty in capturing the carbon dioxide in flue exhaust streams.

Therefore, a need exists for improved methods and systems for thermal recovery of petroleum products from underground reservoirs.

SUMMARY OF THE INVENTION

In one embodiment, a method includes combusting a combination of fuel and oxidant in a flow path through a vapor generator to produce combustion gas and supplying water into the flow path of the vapor generator and in contact with the combustion gas to cool the combustion gas and produce steam. The method further includes supplying a solvent for hydrocarbons into the flow path of the vapor generator to transfer heat to the solvent from the combustion gas already cooled by vaporization of the water. The flow path thereby outputs from the vapor generator a mixture of the combustion gas, the steam and heated solvent vapor.

According to one embodiment, a method includes injecting a mixture of combustion gas, steam and vaporous solvent for hydrocarbons into a reservoir. Direct quenching of the combustion gas with water and then the solvent creates the mixture. In addition, the method includes recovering hydrocarbons from the reservoir that are heated by the mixture and dissolved with the solvent.

For one embodiment a system includes a vapor generator with inputs coupled to fuel, oxidant, water and solvent for hydrocarbons. The inputs are arranged for the fuel and the oxidant to combust within the vapor generator and form combustion gas and are arranged for the water and the solvent to direct quench the combustion gas in succession and thereby produce an output mixture. An injection well couples to the vapor generator to receive the output mixture with the combustion gas, steam and vapor of the solvent and is in fluid communication with a production well disposed in a reservoir.

BRIEF DESCRIPTION OF THE DRAWINGS

The invention, together with further advantages thereof, may best be understood by reference to the following description taken in conjunction with the accompanying drawings.

FIG. 1 is a schematic of a production system utilizing direct steam and solvent vapor generation to supply a resulting thermal fluid into an injection well, according to one embodiment of the invention.

DETAILED DESCRIPTION OF THE INVENTION

Embodiments of the invention relate to methods and systems for recovering petroleum products from underground reservoirs. The recovering of the petroleum products relies on introduction of heat and solvent into the reservoirs. Supplying water and then solvent for hydrocarbons in direct contact with combustion of fuel and oxidant generates a stream suitable for injection into the reservoir in order to achieve such thermal and solvent based recovery.

FIG. 1 illustrates a production system with a direct vapor generator 100 coupled to supply a thermal fluid to an injection well 101. The thermal fluid includes steam and heated solvent vapor produced by the generator 100. In operation, the thermal fluid makes petroleum products mobile enough to enable or facilitate recovery with, for example, a production well 102. The injection and production wells 101, 102 traverse through an earth formation 103 containing the petroleum products, such as heavy oil or bitumen, heated by the thermal fluid and both heated by and dissolved with the solvent vapor. For some embodiments, the injection well 101 includes a horizontal borehole portion that is disposed above (e.g., 0 to 6 meters above) and parallel to a horizontal borehole portion of the production well 102. While shown in an exemplary steam assisted gravity drainage (SAGD) well pair orientation, some embodiments utilize other configurations of the injection well 101 and the production well 102, which may be combined with the injection well 101 or arranged crosswise relative to the injection well 101, for example.

The thermal fluid upon exiting the injection well 101 and passing into the formation 103 condenses and contacts the petroleum products to create a mixture of the thermal fluid and the petroleum products. The mixture migrates through the formation 103 due to gravity drainage and is gathered at the production well 102 through which the mixture is recovered to surface. A separation process may divide the mixture into components for recycling of recovered water and/or solvent back to the generator 100.

The vapor generator 100 includes a fuel input 104, an oxidant input 106, a water input 108 and a solvent input 110 that are coupled to respective sources of fuel, oxidant, water and solvent for hydrocarbons and are all in fluid communication with a flow path through the vapor generator 100. Based on the inputs 104, 106, 108, 110 disposed along the flow path through the vapor generator 100, entry of the water into the flow path occurs between where the solvent enters the flow path and the fuel and the oxidant enter the flow path. Tubing 112 conveys the thermal fluid from the vapor generator 100 to the injection well 101 by coupling an output from the flow path through the vapor generator 100 with the injection well 101.

The direct vapor generator 100 differs from indirect-fired boilers. In particular, transfer of heat produced from combustion occurs by direct contact of the water and the solvent with combustion gasses. This direct contact avoids thermal inefficiency due to heat transfer resistance across boiler tubes. Further, the combustion gasses form part of the thermal fluid without generating separate flue streams that contain carbon dioxide. Utilizing the direct contact for steam generation alone eliminates only some flue gas emissions if desired to also introduce with the steam a solvent vaporized in a separate boiler. High temperatures of the combustion gasses prevent many hydrocarbon solvents from being utilized alone to quench the combustion gasses and vaporize the hydrocarbon solvents since the hydrocarbon solvents tend to degrade or crack above certain temperatures.

In operation, the fuel and the oxidant combine within the direct vapor generator 100 and are ignited such that the combustion gas is generated. The water facilitates cooling of the combustion gas and is vaporized into the steam. In some embodiments, the water cools the combustion gas to below about 575° C. while leaving sufficient heat for transferring to the solvent and still enabling injection of the thermal fluid at a desired temperature. Supplying the solvent into the flow path of the vapor generator 100 thus transfers heat to the solvent from the combustion gas and may vaporize the solvent into the heated solvent vapors. Due to the solvent utilized in some embodiments having a lower heat of vaporization relative to water, overall input of thermal energy required is further reduced compared to use of steam alone even when the steam is generated by the direct contact.

Due to heating of the solvent in the vapor generator 100, the solvent can remain unheated prior to being supplied to the vapor generator 100. Spacing between the solvent input 110 and the fuel and oxidant inputs 104, 106 ensures that the solvent is heated without also being combusted. For example, the solvent may further cool the combustion gas to about a dew point of the thermal fluid or between the dew point and about 575° C. Quantities of the water and the solvent introduced into the flow path of the vapor generator 100 for some embodiments result in the thermal fluid including between about 10% and about 20% by volume of the solvent, between about 80% and about 90% by volume of the steam and remainder being carbon dioxide and impurities, such as carbon monoxide, hydrogen, and nitrogen. Balance between cost of the solvent and influence of the solvent on recovery dictates a solvent to water ratio value utilized in any particular application.

For some embodiments, the solvent includes hydrocarbons, such as at least one of propane, butane, pentane, hexane, heptane, naphtha, natural gas liquids and natural gas condensate. Examples of the oxidant include air, oxygen enriched air and oxygen, which may be separated from air. Sources for the fuel include methane, natural gas and hydrogen.

The preferred embodiment of the present invention has been disclosed and illustrated. However, the invention is intended to be as broad as defined in the claims below. Those skilled in the art may be able to study the preferred embodiments and identify other ways to practice the invention that are not exactly as described herein. It is the intent of the inventors that variations and equivalents of the invention are within the scope of the claims below and the description, abstract and drawings are not to be used to limit the scope of the invention.

The invention claimed is:

1. A method comprising:

injecting a mixture of combustion gas, steam and vaporous solvent for hydrocarbons into a reservoir, wherein direct quenching of the combustion gas with water and then the solvent in a vapor generator creates the mixture and the water cools the combustion gas to below 575° C. prior to the solvent being supplied to the vapor generator to limit cracking of hydrocarbons forming the solvent as heat transfers to the solvent from the combustion gas for vaporizing the solvent that thereby outputs from the vapor generator in the mixture; and recovering hydrocarbons from the reservoir that are heated by the mixture and dissolved with the solvent.

2. The method according to claim 1, wherein the solvent includes at least one of propane, butane, pentane, hexane, and heptane.

3. The method according to claim 1, further comprising injecting the mixture through an injection well into the reservoir, wherein a horizontal injector length of the injection well is disposed between 0 and 6 meters above and parallel to a horizontal producer length of a production well.

4. The method according to claim 1, wherein the mixture includes between 10% and 20% by volume of the solvent.

5. The method according to claim 1, wherein the solvent remains unheated prior to being supplied to the vapor generator.

6. The method according to claim 1, wherein the solvent further cools the combustion gas to a dew point of the mixture.

7. The method according to claim 1, wherein the solvent is supplied into a flow path of the vapor generator downstream from the water being supplied into the flow path.

* * * * *